United States Patent [19]

Frentzel

[11] Patent Number: 4,654,141

[45] Date of Patent: Mar. 31, 1987

[54] IN-LINE FILTER FOR A LOW PRESSURE POOL CLEANING SYSTEM

[75] Inventor: Herman E. Frentzel, Kentfield, Calif.

[73] Assignee: Arneson Products, Inc., Corte Madera, Calif.

[21] Appl. No.: 831,535

[22] Filed: Feb. 21, 1986

Related U.S. Application Data

[62] Division of Ser. No. 708,756, Mar. 6, 1985, Pat. No. 4,592,378, which is a division of Ser. No. 541,193, Jan. 12, 1983, Pat. No. 4,526,186.

[51] Int. Cl.[4] ..... B01D 27/08; B01D 35/16

[52] U.S. Cl. ..... 210/232; 210/409; 210/448; 210/452

[58] Field of Search ..... 210/409, 447, 448, 452, 210/232; 137/238

[56] References Cited

U.S. PATENT DOCUMENTS

| | | | |
|---|---|---|---|
| 629,377 | 7/1899 | Leland | 210/448 X |
| 671,003 | 4/1901 | Ruthenburg | 210/409 |
| 2,078,543 | 4/1937 | Salisbury | 210/409 |
| 2,545,789 | 3/1951 | Miller | 210/447 X |
| 3,862,035 | 1/1975 | Goodman | 210/209 X |

*Primary Examiner*—Philip R. Coe

*Attorney, Agent, or Firm*—Limbach, Limbach & Sutton

[57] ABSTRACT

An improved water jet pool cleaner system includes a pool cleaner with a buoyant housing powered about the pool by forward and reverse driving nozzles so dirt and other debris is gathered at the low point on the bottom of the pool by the action of depending cleaner hoses. Water from the filter pump enters a fluid reservoir from which it flows along parallel flow paths to the forward and reverse driving nozzles, to a turbine, and to the cleaner hoses. Pressurized water is directed to the forward and reverse nozzles through a rotary valve which is rotated by the drive train connected to the turbine. The parallel flow paths permits water to be provided to the driving nozzles, to the turbine and to the cleaner hoses at pressures substantially equal to the fluid reservoir pressure. The system uses a flow diverter downstream of the main pool filter to divert the proper amount of water to the cleaner. Manual and automatic flow diverters and a novel in-line filter are also disclosed.

4 Claims, 16 Drawing Figures

IN-LINE FILTER FOR A LOW PRESSURE POOL CLEANING SYSTEM

This is a division of application Ser. No. 708,756, filed Mar. 6, 1985, and now U.S. Pat. No. 4,592,378, which is in turn a divisional of Ser. No. 541,193, filed Jan. 12, 1983, and now U.S. Pat. No. 4,526,186.

BACKGROUND OF THE INVENTION

In many parts of the country home swimming pools are very popular. A home pool can provide a place of exercise, entertainment and relaxation for the user. One of the drawbacks of owning a pool is the need to keep it clean. Although a pool filter removes contaminants suspended in the water, a film of dirt forms on the bottom and sides of the pool and leaves and other debris collect along the bottom. It is necessary to periodically clean the pool surfaces to remove the surface film and the bottom debris.

Manual pool cleaners typically are based upon a suction principle and are connected to the pool skimmer inlet. However, these manual systems require that the user spend a significant amount of time each week cleaning the pool. Thus, automated systems for pool cleaning have been developed.

One type of automated system, which can be termed a water jet system, uses a buoyant power head connected to a high-pressure water source. One such pool cleaner, disclosed in U.S. Pat. No. 3,291,145 to Arneson, includes a pair of flexible hoses extending downwardly from the buoyant power head. The hoses have nozzles through which high-pressure water streams are ejected. As the buoyant power head moves about the surface of the pool, the cleaner hoses sweep the dirt film from the bottom and sides of the pool and the debris on the bottom of the pool towards the main drain at the pool's lower end. Waterlogged leaves and large debris, collected in one place, can then be removed from the pool. Floating leaves and other material are driven to the edge of the pool where they are removed by the pool skimmer.

Although this type of pool cleaner does a fine job cleaning the pool, a currently available pool cleaner of this type requires that water be delivered to the buoyant power head at about 50 p.s.i. However, the maximum water pressure developed by conventional pool filter pumps is about 20–25 p.s.i. Therefore a booster pump is required to use this type of pool cleaner. The need for two pumps increases the purchase and installation costs of the pool cleaner. Operating two pumps is necessarily less efficient than operating a single pump.

A second type of automatic pool cleaner uses a suction principle. These pool cleaners are typically connected to the skimmer inlet so that no booster pump is needed. Operating this type of pool cleaner does create an additional resistance to flow requiring the filter pump to work harder, and use more energy, compared to the amount it would use without the pool cleaner. One type has a suction head which attaches itself to the bottom and sides of the pool and moves about the pool in little steps. As it does so it sucks up the dirt along the pool surface. Although this type eliminates the need for a separate booster pump, it suffers from the same disadvantge common to most suction-type pool cleaners. That is, all the dirt, waterlogged leaves and other debris removed by the pool cleaner is sucked into the pool filter. This causes the filter to clog up faster so that the filter must be backwashed more often. This is a particular disadvantage when a lot of leaves or other debris collect in the pool. Therefore, if a suction type of pool filter is left unattended for a sufficiently long period, such as can occur during a vacation, the filter may well become so filled with dirt that it becomes ineffective.

SUMMARY OF THE INVENTION

The present invention is directed to a pool cleaning system using an improved water jet type of pool cleaner including a buoyant housing containing a drive unit which delivers water under pressure to one or more flexible, depending hoses which clean the pool. Water from the outlet of the main pool filter passes through an in-line filter before passing through a flow director valve. The director valve is used to direct a fraction of the water from the main filter to a poolside cleaner connection and the remainder along the return line to the main outlet at the pool. A supply hose connects the poolside cleaner connection to the inlet of a fluid distribution manifold on the drive unit. The buoyant housing is powered about the pool by forward and reverse programmed driving nozzles so that the entire pool becomes clean. The dirt and debris is gathered at the low point on the bottom of the pool, typically at the leaf strainer covering the bottom drain. Floating debris is directed to the pool edges where it is collected by the pool skimmer.

Pressurized water is directed to the forward and reverse nozzle units through a rotary valve. The rotary valve is rotated by a drive gear train connected to the turbine wheel. The rotary valve is supplied pressurized water from the manifold. Depending upon the rotary orientation of the rotary valve, water is directed through the rotary valve to either the reverse or foward nozzle units. The forward nozzle unit is rotated along with the rotary valve so the orientation of the forward nozzle changes. The forward nozzle unit includes a nozzle angled relative to the direction in which the supply hose extends from the manifold inlet. The forward and reverse nozzles drive the buoyant power head about the pool in a manner similar to that disclosed in U.S. Pat. No. 3,291,145, the disclosure of which is incorporated by reference.

A primary feature of the present invention is the provision of the manifold to provide the pressurized cleaning fluid, typically water, to the forward and reverse nozzles, to the cleaner hoses and to the turbine wheel at substantially the same pressure. This eliminates the pressure drop which occurs when water passes through the turbine wheel of the prior art water jet type of pool cleaner. In addition, the turbine wheel has been configured to minimize turbulence and windage thus reducing drag. The net effect is that a standard pool filter pump can drive a pool cleaner made according to the present invention without the need of a booster pump. Thus the present invention achieves the cleaning effectiveness of the prior art water jet pool cleaner with the ease of installation, the lower cost and the energy efficiency of suction-type pool cleaners.

The director valve can be of two different types—manually operated or automatic. For both types a pressure gauge is used between the director valve and the poolside cleaner connection to monitor the water pressure at the poolside connection. The user periodically adjusts the manual valve using the pressure gauge as a guide to achieve the proper pressure at the poolside connection. The pressure gauge is also used to determine when the pool filter needs to be backwashed.

The automatic director valve adjusts the flow paths between the poolside connection and the main outlet by monitoring the pressure at an inlet of the director valve and adjusting a variable restriction to the flow path to the main inlet. The pressure gauge is used with the automatic director valve to initially set the valve and to monitor the condition of the main filter for the need to backwash.

The in-line filter is used to trap particles passing from the main pool filter to ensure proper operation and long life for the various pool cleaner components. The in-line filter is specially constructed to provide a very low pressure drop for maximum system efficiency. The in-line filter can be cleaned by merely removing a plug which allows water to flush out the cylindrical filter element. The filter body housing the filter element can be easily removed from a rigid line by backing off a pair of threaded rings which secure the filter body to the ends of the pipes.

Other features and advantages of the present invention will appear from the following description in which a preferred embodiment has been set forth in detail in conjunction with the accompanying drawings.

DETAILED DESCRIPTION OF THE DRAWINGS

DETAILED DESCRIPTION OF THE PREFERRED EMBODIMENT

Figure 1B:
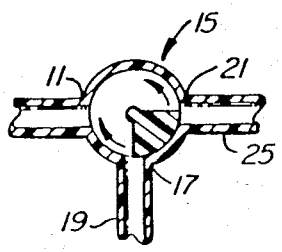
FIG. 1B is an enlarged schematic representation of the director valve of FIG. 1A.
Figure 1A:
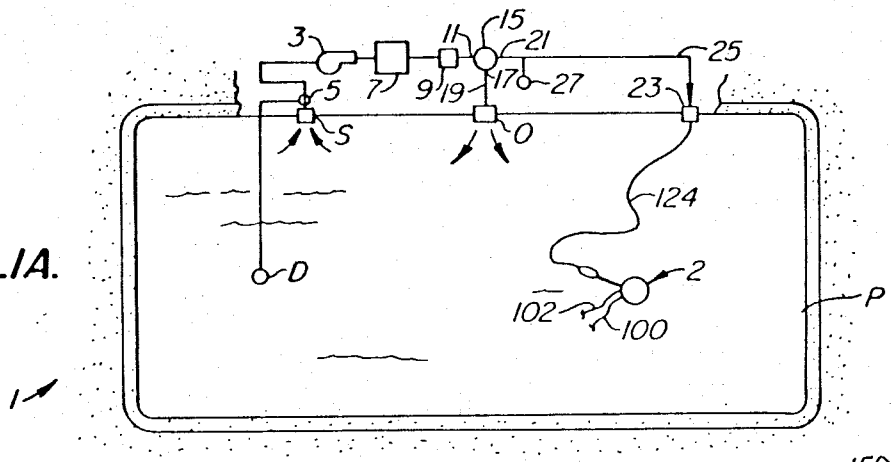
FIG. 1A is a schematic representation of the pool cleaning system of the invention.

Referring now to FIG. 1A, a pool cleaner system 1 includes generally a pool cleaner 2 moving about a pool P. Pool P includes a water drain D, a skimmer inlet S and a main outlet O. Drain D and skimmer inlet S are connected to an inlet of a filter pump 3 through a valve 5, used to proportion the water flow to the filter pump from drain D and skimmer inlet S. The outlet of filter pump 3 is connected to a main filter 7. Pool P, drain D, skimmer inlet S, main outlet O, valve 5, filter pump 3 and filter 7 are all conventional.

A low pressure drop, in-line filter 9 is connected to main filter 7 and an inlet 11 of a flow directing valve 15. Valve 15, shown also in FIG. 1B, has a first outlet 17 connected to main outlet O by a return line 19. Valve 15 includes a second outlet 21 connected to a poolside cleaner connection 23 by a line 25. Pool cleaner 2 is provided with pressurized water from pump 3 at connection 23. The pressure along line 25 is indicated by a pressure gauge 27 connected to line 25 adjacent second outlet 21.

Figure 2:
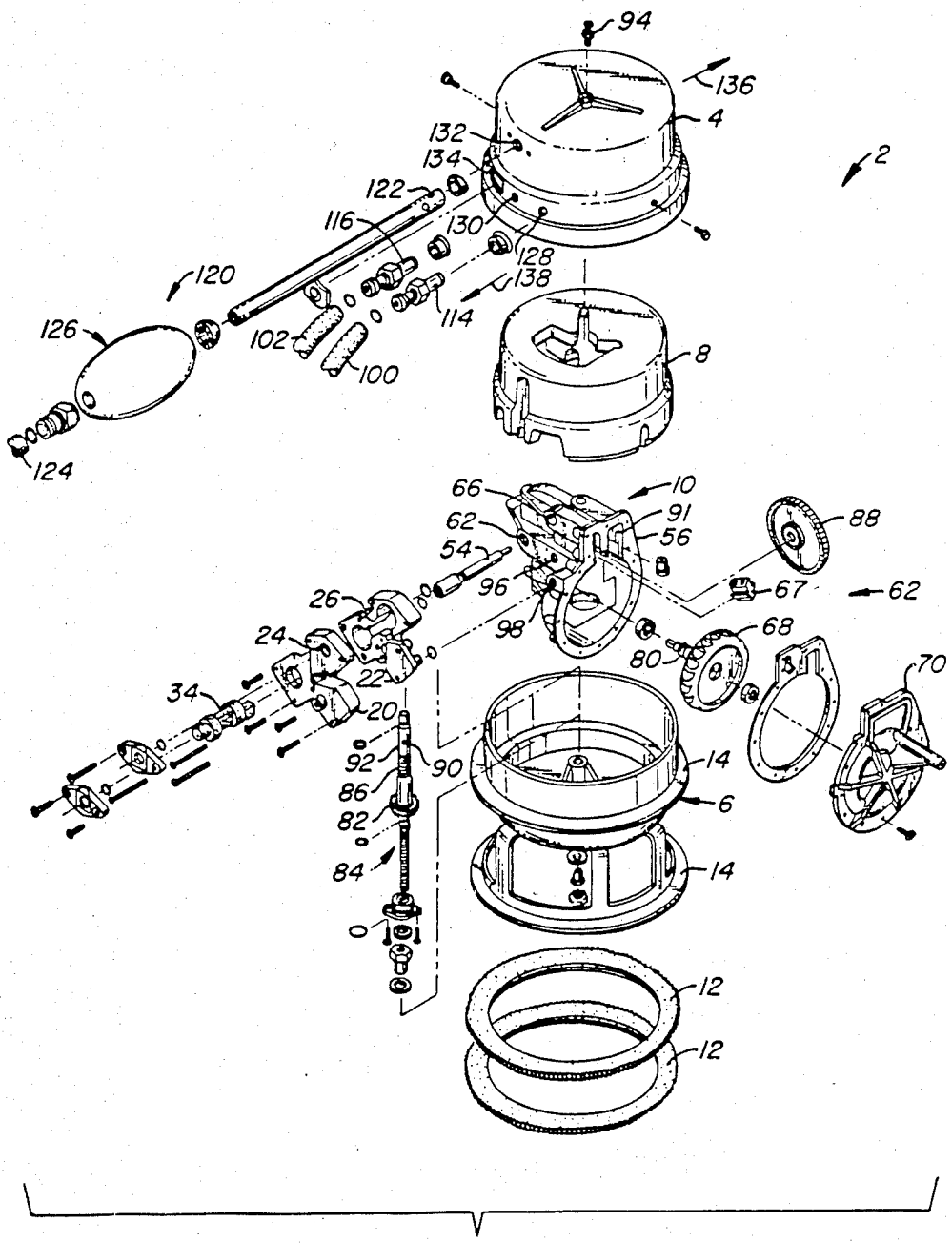
FIG. 2 is an exploded perspective view of a pool cleaner made according to the present invention.

Turning now to FIG. 2, a water jet type of pool cleaner 2 is shown. Cleaner 2 includes a top shell 4, a bottom shell 6, a float 8 and a drive unit 10. Float 8 and drive unit 10 are mounted between top and bottom shells 4, 6. A pair of tires 12 are mounted to a pair of outwardly extending flanges 14 on bottom shell 6. The general configuration of pool cleaner 2 is essentially the same as that sold by Arneson Products, Inc. of Corte Madera, Calif. as Pool Sweep I. It is also similar to the pool cleaner disclosed in U.S. Pat. No. 3,291,145. Therefore, only those features which form a part of or are relevant to the present invention will be described in more detail below.

Figure 4C:
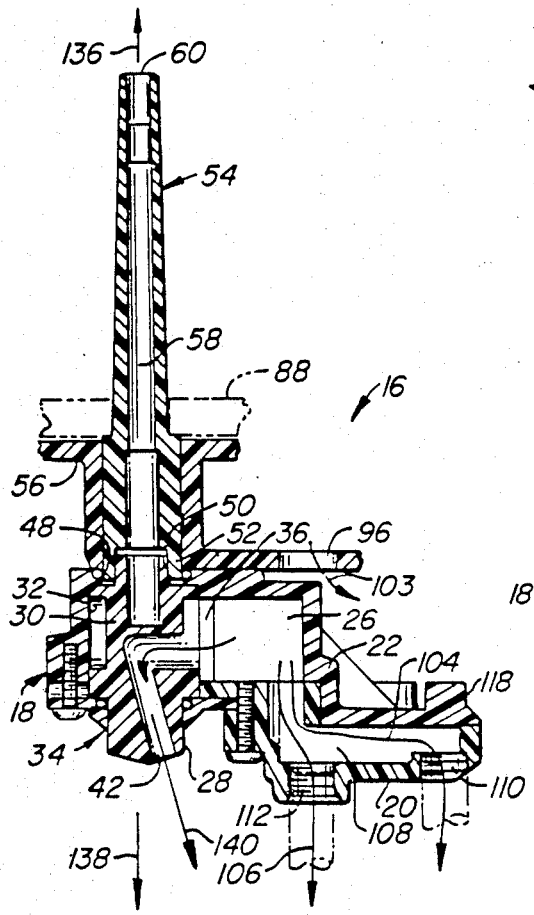
FIG. 4C is a cross-sectional view of the manifold and forward and reverse nozzle units taken along line 4C—4C of FIG. 4A.

The primary distinction between the Arneson Pool Sweep I and the pool cleaner of present invention is the use of a novel water distribution assembly 16, shown in FIG. 4C. Assembly 16 includes a manifold 18 having front and rear covers 20, 22 and a main water inlet 24 formed within front cover 20. Water entering main inlet 24 passes into a hollow interior 26 within manifold 18.

Figure 6:
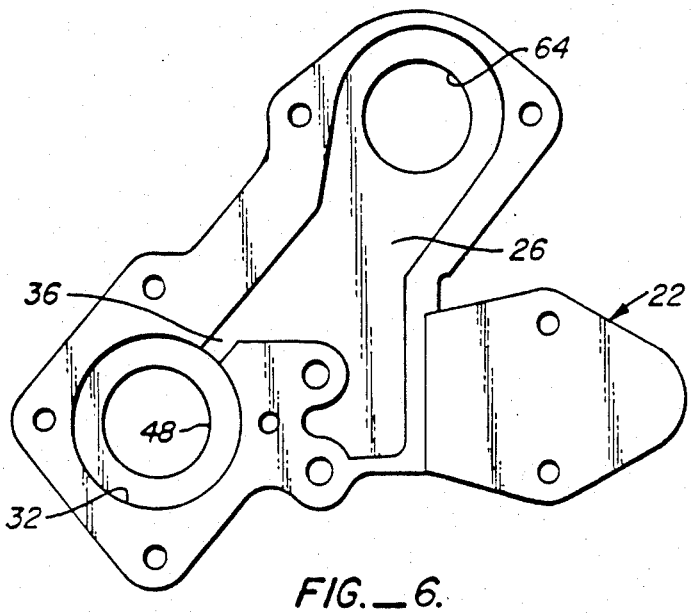
FIG. 6 is a front view of the inside of the rear cover of the manifold of FIG. 4C.

Hollow interior 26 houses a part of a forward valve unit 28 and a rotary valve 30 within a cylindrical portion 32 of rear cover 22. See also FIG. 6. Forward valve unit 28 and rotary valve unit 30 are molded as a unitary structure 34 but may be made from separate components, if desired.

Figure 7:
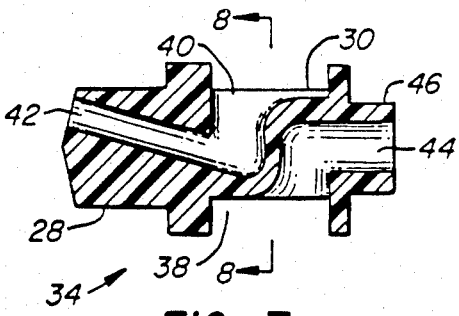
FIG. 7 is a side cross-sectional view of the forward nozzle unit and rotary valve of FIG. 4C.
Figure 8:
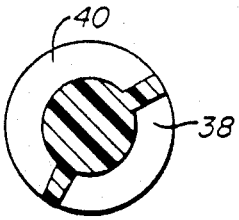
FIG. 8 is a cross-sectional view taken along line 8—8 of FIG. 7.
Figure 9:
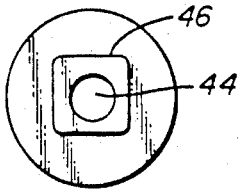
FIG. 9 is an end view of the rotary valve of FIG. 7.

Rotary valve 30, as seen in FIGS. 7, 8, and 9, includes two peripheral regions 38, 40 which fluidly connect a throat region 36 in cover 22 with either a forward nozzle 42, formed within forward nozzle unit 28, or a reverse port 44, formed within one end 46 of rotary valve 30. One end 46 has a square cross-sectional shape and extends through a bore 48 in rear cover 22 for engagement within a correspondingly shaped opening 50 formed within an end 52 of a reverse nozzle unit 54 as shown in FIGS. 2 and 4C. Unit 54 is housed within the casing 56 of drive unit 10 and includes a central bore 58 through which water can pass from throat 36, past region 38, through port 44 and into bore 58 for discharge through a reverse nozzle 60. Together manifold 18, forward valve unit 28, rotary valve 30 and reverse nozzle unit 54 comprise water distribution assembly 16.

Reverse nozzle unit 54, and forward nozzle unit 28 and rotary valve 30 therewith, is rotated by a drive train 62 as described below. Water passing through main inlet 24 and into interior 26 passes directly into drive unit 10 through a bore 64 in rear cover 22. Bore 64 is directly aligned with main inlet 24 in front cover 20 and also with a housing inlet 66 formed in casing 56 of drive unit 10. Water passes through a nozzle 67 in drive unit 10 and is directed against an impulse turbine wheel 68 housed between casing 56 and a cover 70. This is accomplished in a manner similar to that used with the Pool Sweep I. However, to accommodate the lower pressure water, a larger diameter orifice in nozzle 67 is used to direct the water against the blades 72 of turbine wheel 68.

Figure 5:
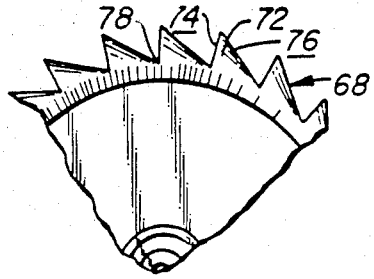
FIG. 5 is an enlarged partial side view of the turbine wheel of FIG. 2.
Figure 4B:
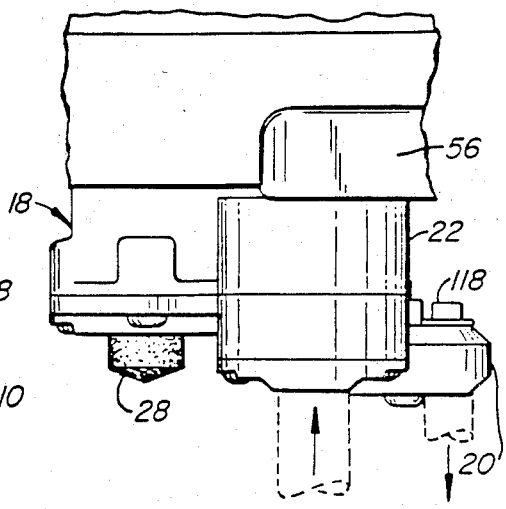
FIG. 4B is a top view of the manifold and forward nozzle of FIG. 3 shown mounted to the drive unit housing.
Figure 4A:
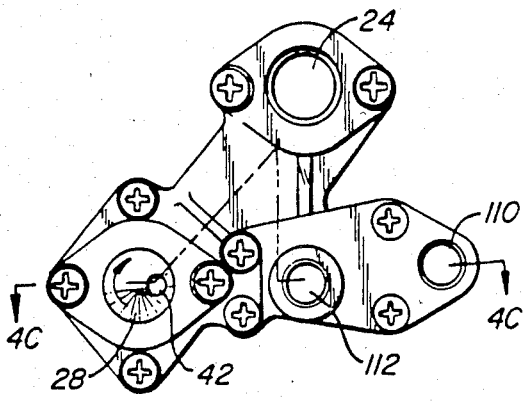
FIG. 4A is a front view of the manifold and forward nozzle unit of FIG. 3.
Figure 3:
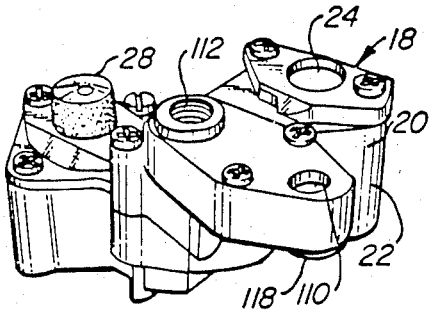
FIG. 3 is a perspective view of the manifold used with the pool cleaner of FIG. 2.

Turbine wheel 68 differs from the prior art turbine wheel in that the blade profile, shown in FIG. 5, is triangular. Each blade 72 has a flat, radially extending forward face 74 and a rearwardly inclined rear face 76 which intersects the base 78 of the forward face 74 of the adjacent blade. Thus blades 72 occupy a greater volume than the relatively thin, flat blades used with the turbine wheel of the Pool Sweep I. This reduces the volume of water carried about between the blades 72 so to reduce turbulence and windage and thus increase the efficiency of the unit. This increase of efficiency is very important because of the limited water pressure available from the filter pump, not shown, for powering drive unit 10.

As is standard with the Pool Sweep I, the impulse turbine wheel 68 includes a first worm 80 which engages a first worm gear 82 on a vertical drive shaft 84. A second worm 86 on shaft 84 engages a second worm gear 88 mounted to reverse nozzle unit 54. See FIGS. 2 and 4C. Water passes through main inlet 24 and bore 64 in manifold 18, through housing inlet 66 and nozzle 67, and past turbine wheel 68 and into the interior of drive unit 10 at a turbine exit 91, thus powering drive train 62. This results in the rotation of second worm gear 88 and reverse nozzle unit 54, to which it is mounted.

Water passes along direct pathways 104, 106 from interior 26 through a region 108 defined between front and rear covers 20, 22, through openings 110, 112 in front cover 20, and through rigid fittings 114, 116 for passage through flexible cleaner hoses 100, 102.

Water which enters housing inlet 66 exits the housing in two ways. Water passes through a lateral bore 90 in vertical drive shaft 84 and into an axial bore in the upper end 92 of shaft 84. This water then passes out through a tile rinser 94 mounted to the tip of upper end of shaft 84. With the prior art Pool Sweep I, water from within unit 10 would also pass through openings 96, 98 for passage into cleaner hoses 100, 102. With the present invention, since there is no need to supply water to the cleaner hoses from the housing, opening 98 is a blind hole. A circular post 118 on rear cover 22 extends into opening 98 when manifold 18 is mounted to drive unit 10 so that opening 98 and post 118 act as positioning aids. Opening 96 is left open to allow the flow of water from turbine wheel 68, out of unit 10 through opening 96, as indicated by arrow 103 in FIG. 4C, and into the pool.

Water is supplied to main inlet 24 by a supply hose 120 similar to that used with the Pool Sweep I. Supply hose 120 includes a first, rigid pipe section 122, a flexible section 124 and a float 126 mounted about the intersection of rigid and flexible sections 122, 124. Rigid section 122 and rigid fittings 114, 116 pass through appropriately placed openings 128, 130, 132 in top shell 4. Such openings are aligned with openings 110, 112 and inlet 24 respectively and permit threadable engagement of fittings 114, 116 and section 122 with their respective openings 110, 112 and inlet 24. An opening 134 is also formed within top shell 4 to accommodate forward valve unit 28.

In use, supply hose 120 is connected to a source of pressurized water, typically from the pool filter pump. Although the present invention may be used with many different sources of pressurized fluid, one of the advantages of the invention is that it can be used with water at the pressures produced by substantially all swimming pool filter pumps. This eliminates the need and cost of obtaining and running a special booster pump. Pressurized water is introduced into manifold 18 through supply hose 120 and main inlet 24 for distribution to rotary valve 30, cleaner hoses 100, 102 and turbine wheel 68 and at substantially equal pressures. This parallel fluid connection eliminates the pressure drop associated with the prior art water jet type pool cleaners in which the water was delivered to the forward and reverse nozzles and to the cleaner hoses only after passing the turbine wheel.

Rotating turbine wheel 68 causes drive train 62 to rotate reverse nozzle 54 and thus rotary valve 30 and forward nozzle unit 28 therewith. As shown in FIG. 8, water is forced through forward nozzle 42 for more than 50 percent of the time and through reverse nozzle 60 for less than 50 percent of the time. Reverse nozzle unit 54 ejects water in a reverse direction 136, which is generally parallel to rigid section 122. Water is ejected through forward nozzle 28 at an angle of about 15° to forward direction 138, that is in the direction of forward nozzle axis 140. As axis 140 precesses about direction 138, it also changes direction with respect to the horizontal and vertical. This prcessional motion causes pool cleaner 2 to move in a manner similar to Pool Sweep I and to the cleaner disclosed in U.S. Pat. No. 3,291,145.

Figure 10:
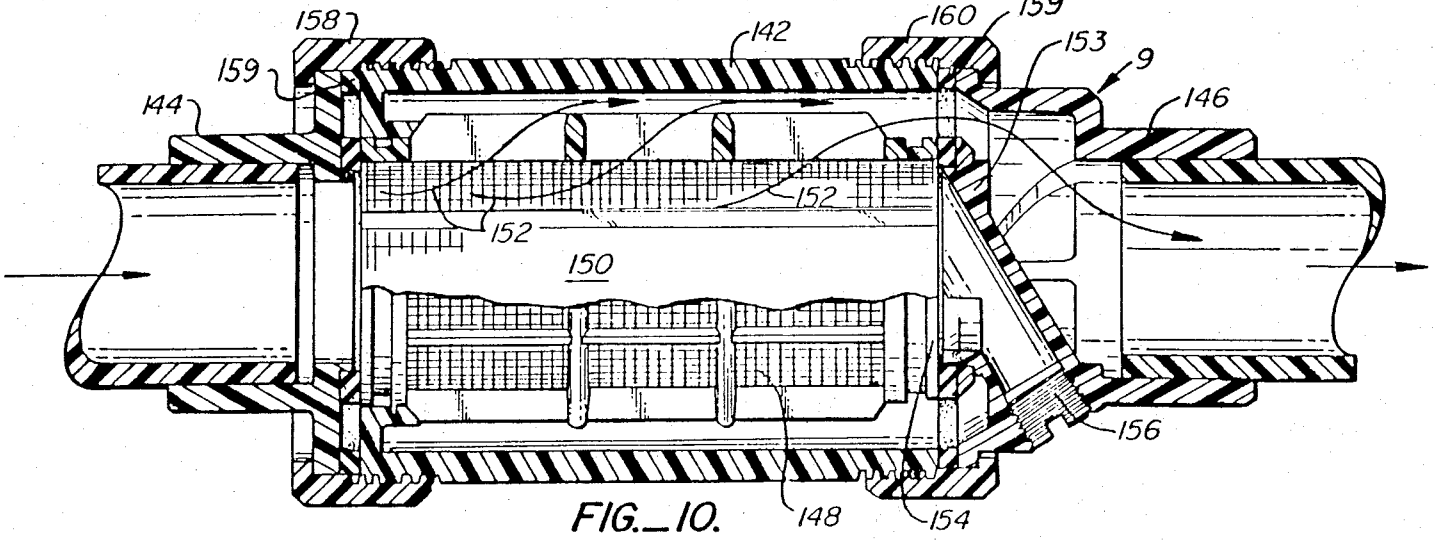
FIG. 10 is a cross-sectional view of an in-line filter of FIG. 1A.

Turning now to FIGS. 1A and 10, in-line filter 9 includes a cylindrical body 142, entrance and exit coupling members 144, 146 and a cylindrical filter element 148 mounted within body 142 and between coupling members 144, 146. Water flowing through entrance member 144 passes into the interior 150 of in-line filter 9, flows along flow paths 152 through filter element 148 and through exit coupling member 146. Since the flow through in-line filter 9 is primarily axial, filter 9 exhibits a very small pressure drop. Central portion 153 of exit member 146 seals the far end 154 of filter element 148 so that all flow from entrance member 144 to exit member 146 must pass through filter element 148. Filter element 148 is cleaned by removing a plug 156 in exit member 146 allowing the water flowing in through entrance 144 to flush out all contaminants from filter element 148.

Occasionally it may be necessary to remove filter body 142 and filter element 148 therein for replacement or thorough cleaning. This is easily accomplished with in-line filter 9. Body 142 is mounted between coupling members 144, 146 by a pair of threaded rings 158, 160. By backing off rings 158, 160 allows filter body 142 and filter element 148 to be removed laterally from between entrance and exit members 144, 146. Preferably, a pair of gaskets 159 are interposed between body 142 and the respective coupling members 144, 146 to enhance sealing.

Referring now to FIG. 1B, flow director valve 15 can be a manually operated three-way valve as schematically indicated at FIG. 1B, such as that sold by Ortega Valve and Engineering Co. of Westminster, Calif., as part no. G65028. With this valve the user manually adjusts the proportion of flow passing through outlets 17 and 21 until the pressure indicated by pressure gauge 27 falls within a desired operating range, typically between about 16 and 21 psi. This range may be indicated by making that segment of the gauge face green. If the gauge reads above 21 psi the user is to adjust director valve 15 to reduce the pressure along line 25. If the pressure drops below 16 psi and adjusting valve 15 does not raise the pressure above 16 psi, it is time to clean main and in-line filters 7 and 9.

Figure 11A:
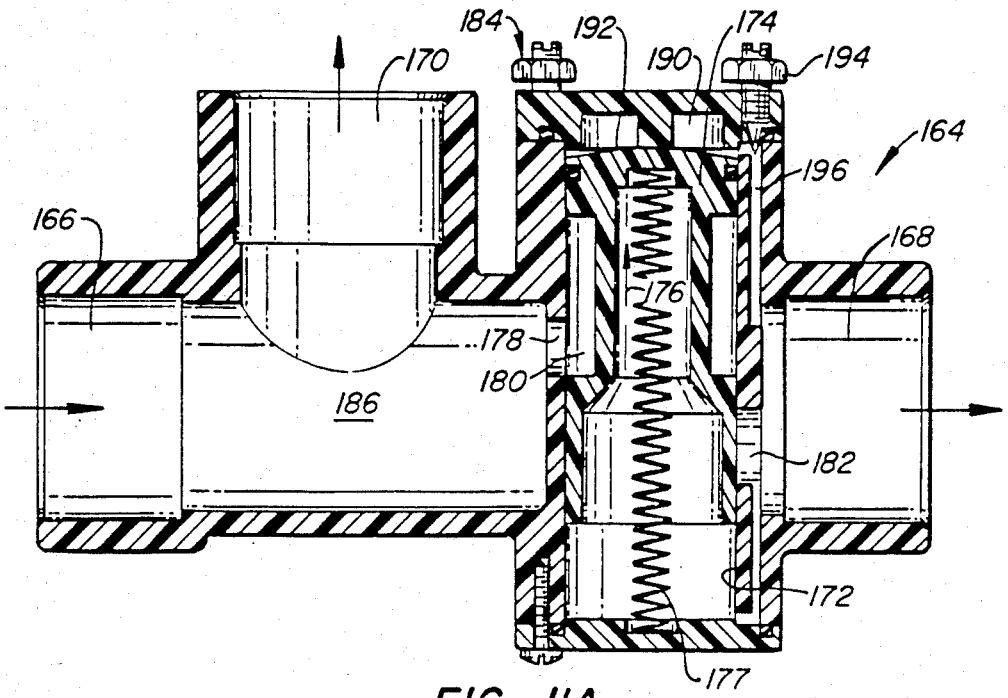
FIG. 11A is a cross-sectional view of an automatic flow director valve.
Figure 11B:
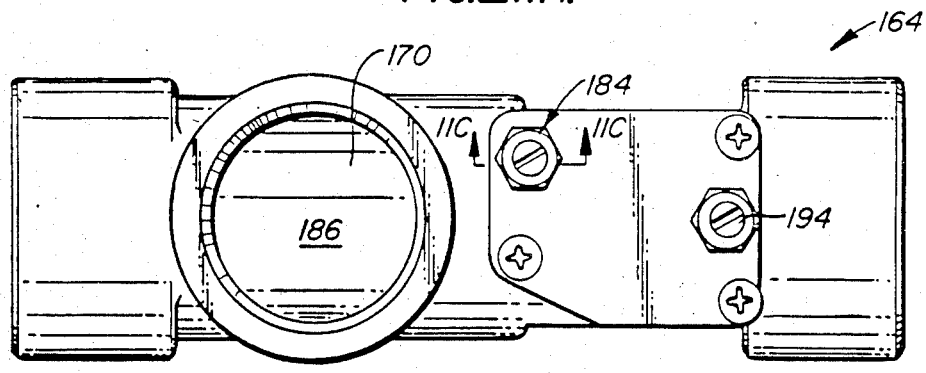
FIG. 11B is a plan view of the valve of FIG. 11A.
Figure 11C:
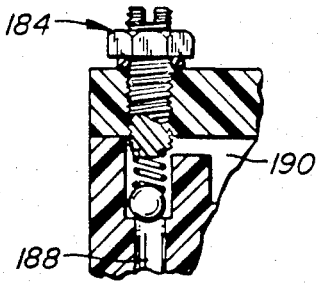
FIG. 11C is a sectional view taken along line 11C—11C in FIG. 11B.

In lieu of manual flow director valve 15, an automatic flow director valve 164, shown in FIGS. 11A–11C, can be used. Automatic valve 164 includes an inlet 166, a first, pool outlet 168 and a second, cleaner outlet 170. Pool outlet 168 is fluidly connected to main outlet O by return line 19 while cleaner outlet 170 is fluidly connected to poolside cleaner connection 23 by line 25. Valve 164 includes a transversely positioned cylinder 172 within which a spool valve 174 is positioned. Valve 174 is biased in the direction of arrow 176 by a spring 177.

Under low pressure conditions, that is when the pressure at the inlet 166 is much less than the chosen minimum operating pressure, for example 16 psi, spool valve 174 will be in its fully forward position of FIG. 11A. When in this position water entering opening 178 and passing into annular chamber 180 surrounding spool valve 174 cannot pass through outlet opening 182 because spool valve 174 is too far in the direction of arrow 176. However, when the water pressure at inlet 166 is at or above the minimum operating pressure, an adjustable pressure ball check valve 184, shown in FIG. 11C, allows water from within the interior 186 of director valve 164 to flow through a passageway 188, past ball check valve 184 and into a region 190 above the face 192 of spool valve 174. This pressurized water forces valve 174 in the direction opposite arrow 176. The distance valve 174 moves is determined by the pressure within interior 186 and thus region 190. This in turn determines to what extent outlet opening 182 is uncovered by spool valve 174. By properly sizing the various components and openings, the flow path between inlet 166 and outlet 168 can be properly constricted to provide water to connection 23 at the proper pressure. A needle valve 194 allows any water trapped within region 190 to slowly and controllably bleed off to pool outlet 168 along a passageway 196 connecting region 190 and pool outlet 168.

Use of automatic director valve 164 eliminates the periodic adjustment which is needed with manual valve 15 as a result of filter 7 becoming filled with dirt. However, it is still preferred to use a pressure gauge 27 along line 25 to monitor the condition of filters 7 and 9.

As has been discussed above, the primary emphasis with pool cleaning system 1 is the elimination of or the minimizing of pressure drops along the flow paths. Director valves 15, 164 are configured to provide changing orifice sizes along the flow paths to main outlet O and poolside cleaner connection 23. Inefficient throttling type of flow controllers are not used. The losses associated with valves 15 and 164 are only of the orifice type thus minimizing pressure drop.

The present invention has been described relative to an embodiment in which a commercially available pool cleaner has been modified by mounting a manifold to the outside of the casing, replacing its valved drive jets with forward nozzle unit 28, rotary valve 30 and reverse nozzle unit 54, and modifying the shape of the blades on the turbine wheel. This embodiment makes it possible to manufacture the pool cleaner of the present invention as an adaptation of the commercially available pool cleaner with minimal tooling changes. The present invention may also be provided in the form of a kit for modifying existing water jet type pool cleaners.

Other modification and variation can be made to the disclosed embodiment without departing from the subject of the invention as defined in the following claims. For example, the particular configuration of manifold 18 can be changed so long as fluid from main inlet 24 is supplied directly, that is in parallel, to rotary valve 30, turbine wheel 68 and cleaner hoses 100, 102. Forward nozzle unit 28 may be made stationary with more than one forward nozzle, each fluidly connected to interior 26 according to the orientation of the rotary valve. Also, manifold 18 may be incorporated into a drive unit modified to provide a common fluid reservoir and parallel fluid paths to the forward and reverse nozzles,the cleaner hoses and the turbine wheel according to the present invention.

I claim:

1. An in-line filter for a low pressure pool cleaning system comprising:

a cylindrical body, housing a tubular filter element, with the outer surfaces of said filter element being spaced from the inner surface of said body to define a channel;

coupling members having end surfaces aligned with corresponding end surface of the cylindrical body, each end surface defining a flat, radially directed plane; and attachment members generally surrounding the opposed end surfaces and forming a fluid tight seal therebetween such that fluid entering said filter is directed into said filter element and then through said channel and out said filter with the path of said fluid flow being primarily axial such that said filter exhibits a low pressure drop and wherein the coupling member located at the downstream end of said in-line filter includes a removable plug to provide a temporary alternate outlet path for the fluid entering the in-line filter to permit contaminants to be flushed from the filter element housed therein.

2. An in-line filter as recited in claim 1, wherein said attachment members, body and coupling members are sized to allow said attachment members to move axially past said abutting end surfaces, allowing said body and filter element therein to be removed laterally from between said coupling members.

3. An in-line filter as recited in claim 1, wherein the attachment members are threaded.

4. An in-line filter as recited in claim 1, wherein the attachment members are threaded rings.

* * * * *